US011255125B2

(12) United States Patent
Rihl et al.

(10) Patent No.: US 11,255,125 B2
(45) Date of Patent: Feb. 22, 2022

(54) ACCESS CONTROL DEVICE FOR PERSONS OR VEHICLES

(71) Applicant: SKIDATA AG, Grödig/Salzburg (AT)

(72) Inventors: Marco Rihl, Grödig/Salzburg (AT); Richard Kobler, Grödig/Salzburg (AT)

(73) Assignee: SKIDATA AG, Grödig/Salzburg (AT)

( * ) Notice: Subject to any disclaimer, the term of this patent is extended or adjusted under 35 U.S.C. 154(b) by 213 days.

(21) Appl. No.: 16/695,572

(22) Filed: Nov. 26, 2019

(65) Prior Publication Data

US 2020/0165867 A1 May 28, 2020

(30) Foreign Application Priority Data

Nov. 28, 2018 (EP) ..... 18208804

(51) Int. Cl.
*E06B 11/08* (2006.01)
*E01F 13/04* (2006.01)
(Continued)

(52) U.S. Cl.
CPC ..... *E06B 11/085* (2013.01); *E01F 13/04* (2013.01); *E06B 11/025* (2013.01); *E06B 11/08* (2013.01); *G07C 9/15* (2020.01)

(58) Field of Classification Search
CPC ..... E06B 11/085; E06B 11/08; E06B 11/025; E01F 13/04
(Continued)

(56) References Cited

U.S. PATENT DOCUMENTS 220,624 A * 10/1879 Jörgensen ..... E01F 13/06 49/49
3,742,647 A * 7/1973 Tomita ..... E06B 11/085 49/35
(Continued)

FOREIGN PATENT DOCUMENTS

FR 2454505 A1 11/1980
JP 2004-110263 A 4/2004
WO WO-9964708 A1 * 12/1999 ..... E06B 11/085

OTHER PUBLICATIONS

Japanese Office Action dated Jan. 26, 2021—English translation thereof.
(Continued)

*Primary Examiner* — Marcus Menezes
(74) *Attorney, Agent, or Firm* — Finch & Maloney, PLLC; Michael Bujold; Jay Franklin

(57) ABSTRACT

An access control device (1) for blocking or opening a passage (2) for persons or vehicles. The access control device comprises one or two blocking bodies (3, 3'), each arranged on a carrier (4, 4'). Each blocking body (3, 3') comprises a mechanically reversibly deformable element (5, 5') which, in a first position, is substantially planar and opens the passage (2) and, in a second position, assumes a curved shape which blocks the passage (2). One or both ends of the deformable element (5, 5') are connected to an actuator (7). A controller controls the deformable element for transferring them first between the first and second positions. When transferring the deformable element from the first to the second position, either the distance between the ends of the respective blocking body is reduced or, when the ends have a constant distance, the length of the blocking body is increased.

12 Claims, 7 Drawing Sheets

(51) Int. Cl.
*E06B 11/02* (2006.01)
*G07C 9/15* (2020.01)

(58) Field of Classification Search
USPC ..... 49/49, 34
See application file for complete search history.

(56) References Cited

U.S. PATENT DOCUMENTS

| | | | | |
|---|---|---|---|---|
| 3,753,317 | A * | 8/1973 | Turpin | G07F 17/145 49/35 |
| 6,185,867 | B1 * | 2/2001 | McGuire | E06B 11/085 49/109 |
| 8,595,975 | B2 * | 12/2013 | van de Water | E06B 11/085 49/68 |
| 2006/0101716 | A1 * | 5/2006 | Vandyck | G07C 9/10 49/35 |
| 2013/0031838 | A1 * | 2/2013 | van de Water | E06B 11/085 49/49 |
| 2015/0033629 | A1 * | 2/2015 | Barwick | E06B 11/085 49/13 |

OTHER PUBLICATIONS

European Search Report issued in corresponding European Patent Application No. 18 208 804.7 dated May 15, 2019.
European Search Report issued in corresponding European Patent Application No. 18 208 804.7 dated Oct. 29, 2020.

* cited by examiner

ACCESS CONTROL DEVICE FOR PERSONS OR VEHICLES

This application claims priority from European patent application serial no. 18208804.7 filed Nov. 28, 2018.

FIELD OF THE INVENTION

The present invention relates to an access control device for persons or vehicles.

BACKGROUND OF THE INVENTION

Access control devices for persons are known from the prior art. They comprise means for preferably non-contact detection and evaluation of access authorizations and mechanical or other blocking bodies, for example, in the form of turnstiles, turnstiles having one, two or three blocking arms, sliding doors, lift sliding doors or so-called flap gates, wherein the blocking bodies are only actuated automatically or manually in the opening direction after presentation of a valid access authorization. Access control devices for vehicles comprise a blocking body, which is usually designed as a vehicle barrier comprising a barrier column, a barrier boom and a drive for pivoting the barrier boom between the blocking and the open position.

Suitable blocking bodies are chosen depending on the desired comfort and/or the desired level of security. Comfort when passing through is adversely affected for turnstiles having three blocking arms, for example, due to the fixed angle between the blocking arms, for example, since luggage or strollers must be lifted over one of the three blocking arms. However, they have the advantage in that they ensure a sufficient locking and separating effect, since a person is always located between two barrier arms when passing through. Such blocking bodies are often used in access control devices in stadiums or ski areas. In addition, the entire passage cannot be released, since, the angle between the longitudinal axes of two adjacent blocking arms is usually 120°, and a blocking arm always protrudes into the passage. However, turnstiles having three blocking arms have the advantage that they ensure a sufficient locking and separating effect, since a person is always passing through between two blocking arms.

Furthermore, turnstiles having two blocking arms are known, which are rotatably connected to a shaft driven by an electric motor, which, however, cannot eliminate the aforementioned disadvantages of the turnstile comprising three blocking arms. Rather, a safe separation is impaired. Furthermore, turnstiles having a blocking arm are known, which, however, moves very quickly to ensure a separation, on the one hand, to release the passage and on the other hand to ensure a separation, thereby increasing the risk of injury to persons walking through. Furthermore, the wear is increased disadvantageously due to the high rotational speed of the mass of a blocking arm; the high rotational speed is due to the fact that the single blocking arm has to be rotated 360 degrees per pass.

In addition, turnstiles having two or three blocking arms known from the prior art have the disadvantage that the entire passage cannot be released in an emergency, or when the system is to be switched out of service.

Furthermore, the blocking bodies used are dependent on the type of access control devices. For example, a safe separation should be ensured in access control devices in a ski resort in the winter, whereas in the summer, access for cyclists, hikers, etc. should be made comfortable.

SUMMARY OF THE INVENTION

The present invention has for its object to provide an access control device for people or vehicles comprising at least one blocking body, which ensures a good separation with simultaneous release of the entire passage in the case of a valid access authorization or in an emergency. Furthermore, the transfer of the blocking body from a blocking position to a release position and vice versa should be done quickly, preferably within a maximum period of 2 seconds. In addition, the access control device according to the invention should be designed compact and require little space.

This object is solved by the features of the independent claim(s). Further embodiments and advantages of the invention are apparent from the dependent claims.

Accordingly, an access control device for persons or vehicles for blocking or releasing a passage is proposed, the access control device comprising one or two blocking bodies, which are each arranged on a carrier, the blocking bodies each having a mechanically reversibly deformable element, for example, as a single or multilayer leaf spring or as a rod-shaped round spring, the element's side facing the passage being substantially planar and completely releasing the passage in a first position and in a second position, assuming a curved shape, for example, a circular arc or elliptical arc shape, which in the case of one blocking body being provided, blocks the passage.

When two blocking bodies are provided, the passage is partially blocked by a respective blocking body, so that the combination of the two blocking bodies blocks the passage.

The blocking bodies can be arranged arbitrarily with respect to the passage plane.

According to one embodiment of the invention, the surface normal of the respective mechanically reversibly deformable element designed as a leaf spring, in a first position, extends parallel to a plane perpendicular to the passage plane and to the passage direction. In particular, the surface normal of the respective element designed as a leaf spring can extend parallel or perpendicular to the passage plane in the first position.

The longitudinal axes of the mechanically reversibly deformable element in the first position can, for example, extend perpendicular, parallel or at any angle to the passage plane.

Furthermore, one or both ends of the respective mechanically reversibly deformable element are connected or operatively connected to a respective actuator which is connected to the respective carrier and can be controlled by a controller, by the control of which the mechanically reversibly deformable element is transferred from the first to the second position and vice versa, wherein for transferring the mechanically reversibly deformable element from the first to the second position, the distance between the ends of the respective blocking body is reduced or the length of the blocking body is increased when there is a constant distance between the ends of the respective blocking body.

The respective actuator can be a hydraulically, pneumatically, electrically or electromagnetically axially displaceable component along a direction parallel to the longitudinal axis of the mechanically reversibly deformable element in the first position, wherein the axial displacement of the distance between the ends of the respective blocking body is varied. For example, the actuator can be an electric motor, the rotor of which drives a toothed wheel which meshes with a toothed rack provided on the carrier.

To vary the length of the respective blocking body when there is a constant distance between the ends of the blocking body, the respective actuator is designed as an electrically driven roller on which the respective end of the mechanically reversibly deformable element designed as a leaf spring can be wound up and can be unwound from the respective end of the element designed as a leaf spring. According to further embodiments, the change between the two positions can be accelerated, in which the rollers are additionally designed to be axially displaceable by a further actuator.

When two blocking bodies are provided, the respective carriers are arranged, for example, each on one opposite side of the passage and mirror-symmetrical to the central longitudinal axis of the passage.

According to the invention, both ends of the respective mechanically reversibly deformable element can each be connected to an actuator; alternatively, one end of the respective mechanically reversibly deformable element can be connected to an actuator, wherein the other end is connected to the carrier by a hinge. The length of the respective blocking body corresponds to the length of the respective mechanically reversibly deformable element between the two actuators or between the actuator and the hinge.

According to one embodiment of the invention, the hinges can be designed such that they each allow a predetermined angle with respect to the first position. In this way, the point at which the mechanically reversibly deformable element has the greatest deformation with respect to the first position can be adjusted. For example, by varying the maximum permitted angle of the hinges in the case of a mechanically reversibly deformable element, the longitudinal axis of which extends perpendicular to the passage plane in the first position, the height of the point having the greatest distance from the carrier can be varied with respect to the passage plane.

When both ends of the respective mechanically reversibly deformable element are each connected to an actuator and the longitudinal axis of the respective mechanically reversibly deformable element extends perpendicular to the passage plane in the first position, the height can be adjusted by an axial displacement of the two actuators by the same distance at which the passage is blocked, allowing the access control device to adapt to different conditions.

According to a further embodiment of the invention, one end of the respective mechanically reversibly deformable element can be connected respectively to an actuator or by a hinge to the carrier, wherein the other end is connected in a hinged manner to one end of a non-elastic element, the other end of which is connected to an actuator, whereby the other end of the mechanically reversibly deformable element is operatively connected to the actuator via the non-elastic element. In this case, the length of the respective blocking body corresponds to the length of the respective mechanically reversibly deformable element plus the length of the non-elastic element connected in a hinged manner to the element designed as a leaf spring.

The ends of the blocking bodies are defined by the actuators and, if present, by the hinges.

Furthermore, in particular when the mechanically reversibly deformable element is designed as a leaf spring, the actuator connected to the respective mechanically reversibly deformable element can be an electrically driven roller on which the respective end of the mechanically reversibly deformable element can be wound up and from which the respective end of the mechanical reversibly deformable element can be unwound, wherein the respective actuator connected to the non-elastic element is a hydraulically, pneumatically, electrically or electromagnetically axially displaceable component along a direction parallel to the longitudinal axis of the respective mechanically reversibly deformable element in the first position.

Preferably, the mechanically reversibly deformable element of a blocking body is made of rubber, metal, fiberglass reinforced plastic, laminated plastic or a further elastic material and has a torsional rigidity, by which a human above-average force is made impossible; the non-elastic element, if provided, is preferably made of metal or plastic.

According to further embodiments, the mechanically reversibly deformable element can consist of a plurality of individual links of the same or different lengths designed connected in a hinged manner to each other, elastically or non-elastically, wherein the curved shape, which the mechanically reversibly deformable element assumes in the second position, can be influenced by the length and arrangement of the individual links. The point at which the element has the greatest deformation with respect to the first position is a function of the length and arrangement of the individual links.

The transfer of the mechanically reversibly deformable element from the first to the second position is supported by the shape of the element. In particular, in the first position, the side of the element designed as a leaf spring facing the carrier can be convex with respect to the carrier. Furthermore, the side of the mechanically reversibly deformable element facing the passage can be slightly convex with respect to the carrier, that is, the element is slightly curved in the direction of the passage.

Within the scope of further embodiments, lighting means, for example, LEDs, can be integrated into the mechanically reversibly deformable element. It is also possible for the mechanically reversibly deformable elements to be connected to a film connected to the carrier, which film is tensioned in the second position, wherein the film can be illuminated and can contain, for example, advertising.

According to further embodiments of the invention, the side of the mechanically reversibly deformable elements facing the passage can be designed fully or partially padded. Furthermore, at least one sensor connected to the controller can be integrated into the side of the mechanically reversibly deformable elements facing the passage, which sensor detects a contact or an imminent contact with a person or an object, for example, a vehicle during the transition from the first to the second position, wherein upon detection of a contact, the process is interrupted and the at least one blocking body is transferred to the first position. The sensor can be designed, for example, as an optical or ultrasonic proximity sensor.

Furthermore, the current consumption of the actuators can be detected continuously, wherein when a threshold value is exceeded when transferring the at least one blocking body from the first to the second position, before reaching the second position, a touching of at least one blocking body to a person or an object is detected and the blocking body is transferred to the first position.

BRIEF DESCRIPTION OF THE DRAWINGS

The invention is explained in more detail below by way of example with reference to the attached figures. Shown are.

DETAILED DESCRIPTION OF THE PREFERRED EMBODIMENTS

Figure 1:
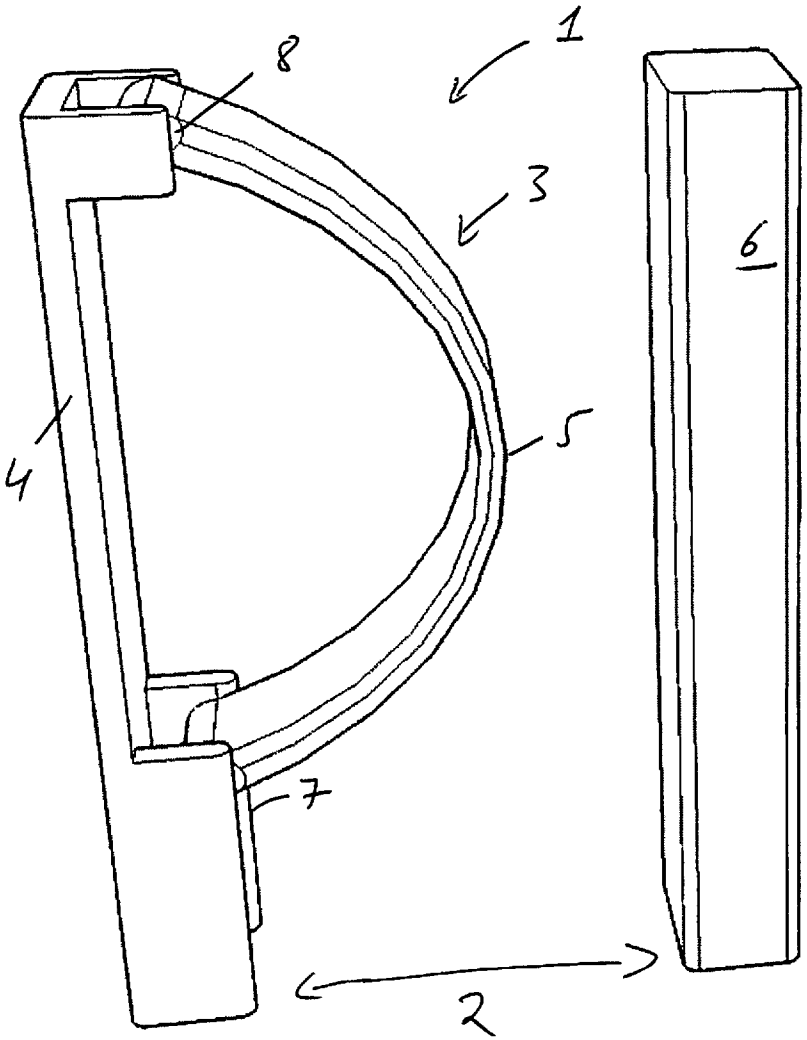
FIG. 1: A schematic view of a first embodiment of an access control device according to the invention comprising a blocking body having a mechanically reversibly deformable element designed as a leaf spring, wherein the blocking body is located in the second position.

According to the invention and with reference to FIG. 1, an access control device 1 for persons or vehicles for blocking or releasing a passage 2 comprises a blocking body 3, which is respectively arranged on a carrier 4, the blocking body 3 having a mechanically reversibly deformable element 5 designed as a single or multilayer leaf spring, the element's side facing the passage 2 being substantially planar in a first position and completely releasing the passage 2 and in a second position, assuming a circular arc or elliptical arc shape blocking the passage of persons or vehicles, as illustrated with reference to FIG. 1. In this case, the passage 2 is defined by the carrier 4 and a column 6. In this case, the longitudinal axis of the element 5 designed as a leaf spring extends perpendicular to the passage plane in the first position.

Figure 2:
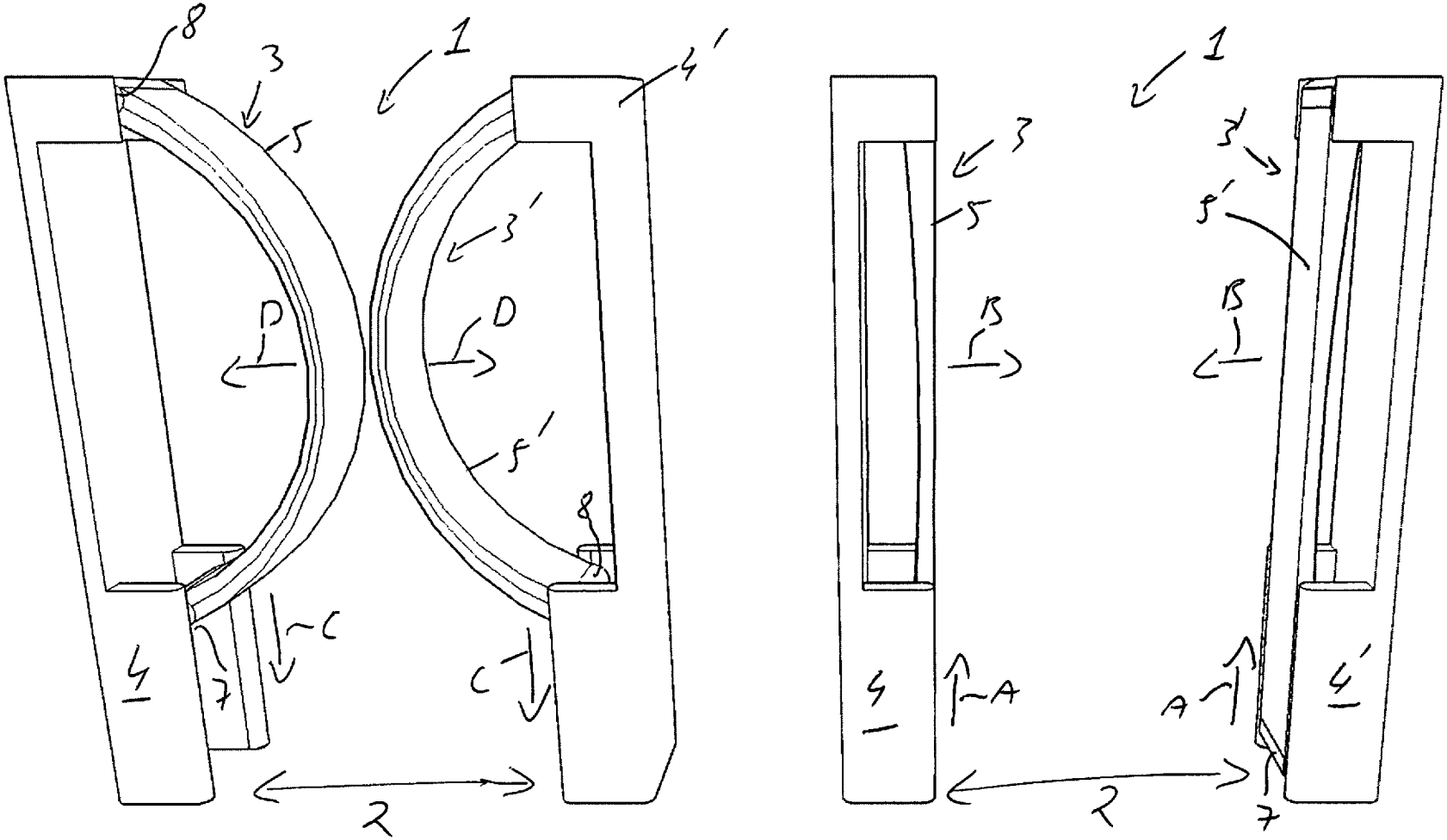
FIG. 2: A schematic view of a second embodiment of an access control device according to the invention comprising two blocking bodies each having a mechanically reversibly deformable element designed as a leaf spring, wherein in the right part of the figure, the blocking bodies are shown in the second position and in the left part of the figure, the blocking bodies are shown in the first position.

In the example shown in FIG. 2, the access control device 1 comprises two blocking bodies 3, 3', which are each arranged on a carrier 4, 4', and each having an element 5, 5' designed as a single or multilayer leaf spring, which define the passage 2. In this case, in the second position according to the left part of FIG. 2, the passage 2 is partially blocked by a respective element 5, 5' designed as a single or multilayer leaf spring, so that the passage 2 is blocked for persons or vehicles by the combination of both blocking bodies 3, 3'. According to the right part of FIG. 1, the passage is completely released in the first position.

The surface normal of the respective leaf spring element 5, 5' extends, in the first position, parallel to a plane extending perpendicular to the passage plane and to the passage direction. In the embodiments according to FIGS. 1 and 2, the surface normal of the respective element 5, 5' designed as a leaf spring extends parallel to the passage plane in the first position, wherein the longitudinal axes of the elements 5, 5' designed as leaf springs extend perpendicular to the passage plane in the first position.

Figure 3:
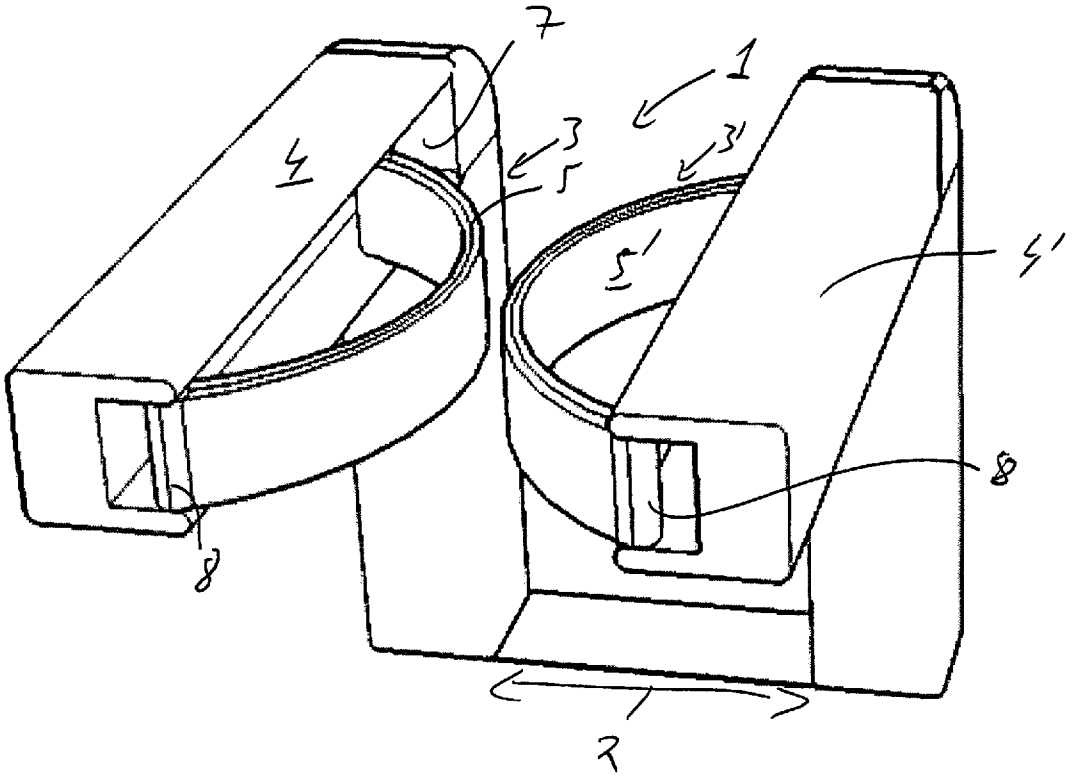
FIG. 3: A schematic perspective view of a third embodiment of an access control device according to the invention, comprising two blocking bodies, each having a mechanically reversibly deformable element designed as a leaf spring, wherein the blocking bodies are located in the second position.

The embodiment according to FIG. 3 differs from the embodiment according to FIG. 2 in that the longitudinal axes of the elements 5, 5' designed as leaf springs extend parallel to the passage plane in the first position.

In the embodiments according to FIGS. 1, 2 and 3, one end of the respective element 5, 5' designed as a leaf spring is respectively connected to an actuator 7 which is connected to the respective carrier 4, 4' and controllable by a controller, by the control of which the element 5, 5' designed as a leaf spring is transferred from the first to the second position and vice versa. The other end is connected by a hinge 8 to the carrier 4, 4', wherein the hinge axis extends perpendicular to the longitudinal axis and the surface normal of the elements 5, 5' designed as leaf springs in the first position.

In order to transfer an element 5, 5' designed as a leaf spring from the first to the second position, according to an embodiment of the invention, the distance between the ends of the respective blocking body 3, 3' is reduced, as illustrated with reference to FIG. 2. In the examples shown in FIGS. 1, 2 and 3, the length of the respective blocking body 3, 3' corresponds to the length of the respective element 5, 5' designed as a leaf spring.

Starting from the state shown in the right part of FIG. 2, the actuators 7 connected to one end of the respective blocking body 3, 3' are displaced axially upward in the direction of the arrows A parallel to the longitudinal axis of the elements 5, 5' designed as leaf springs in the first position, whereby the elements 5, 5' designed as leaf springs each curve in the direction of the passage, which is indicated by the arrows B in order to reach the second position according to the left part of FIG. 2 and to block the passage. Starting from the state according to the left part of FIG. 2, the actuators are axially displaced downwards in the direction of the arrows C, whereby the elements 5, 5' designed as leaf springs move in the direction of the arrows D in order to reach the first position and to completely release the passage 2.

Figure 5:
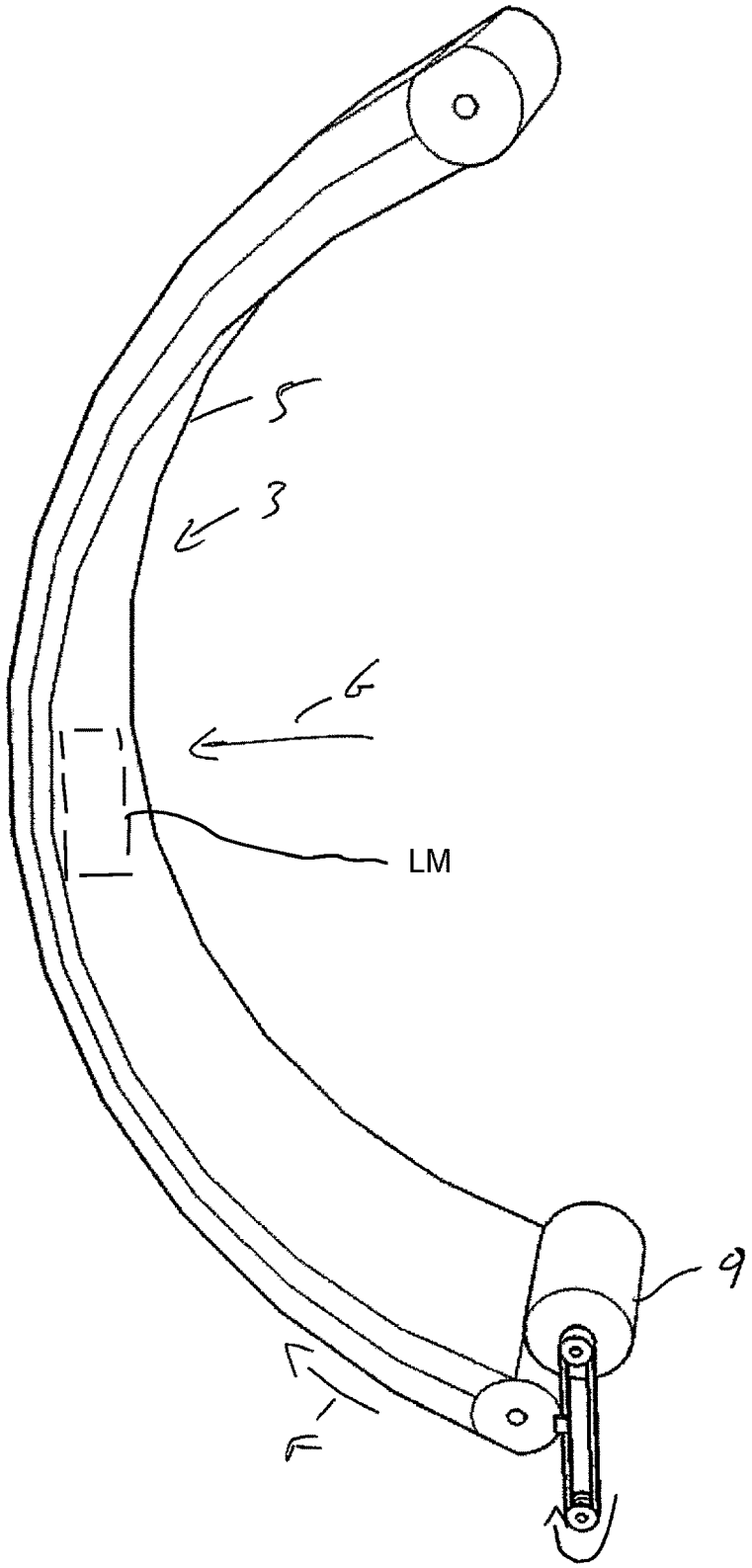
FIG. 5: A schematic perspective view of a blocking body designed according to an embodiment of the invention and an actuator for illustrating the principle according to the invention for controlling the blocking body.

As an alternative to reducing the distance between the ends of the respective blocking body 3, 3', the length of the respective blocking body 3, 3' can be enlarged with constant distance between the ends of the blocking body to transfer an element 5, 5' designed as a leaf spring from the first position to the second position. In this case, referring to FIG. 5, the actuator is designed as an electrically driven roller 9, on which the respective end of the element designed as a leaf spring can be wound up and from which the respective end of the element designed as a leaf spring can be unwound. In order to reach the second position shown in FIG. 5, starting from the first position, the roller 9 is rotated in the direction of arrow E, whereby the element 5 designed as a leaf spring is unwound F from the roller 9 in the direction of arrow and the element 5 curves in the direction of the arrow G. Lighting means LM, for example, may be integrated into the mechanically reversibly deformable element 5, 5'.

Figure 4:
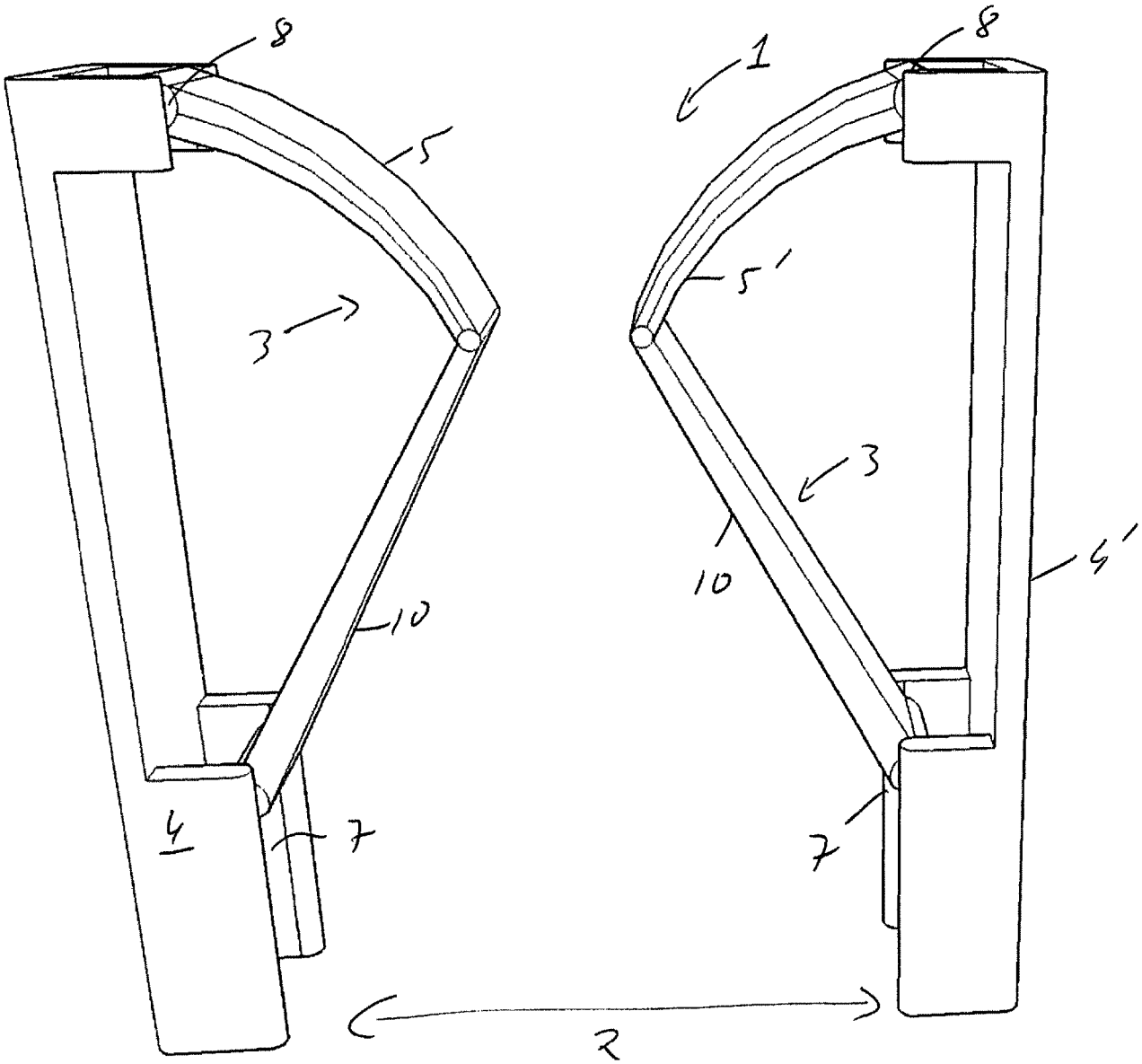
FIG. 4: A schematic view of a fourth embodiment of an access control device according to the invention, comprising two blocking bodies, each having a mechanically reversibly deformable element designed as a leaf spring, wherein the blocking bodies are located in the second position.

In the example shown in FIG. 4, one end of the respective element 5, 5' designed as a leaf spring is connected to the carrier 4, 4' by a hinge 8, wherein the other end is connected in a hinged manner to one end of a non-elastic element 10, the other end of which is connected to an axially displaceable actuator 7 for varying the length between the ends of the blocking body 3, 3'. In this case, the length of the respective blocking body 3, 3' corresponds to the length of the respective element 5, 5' designed as a leaf spring plus the length of the non-elastic element 10 connected in a hinged manner to the element 5, 5' designed as a leaf spring.

Figure 6:
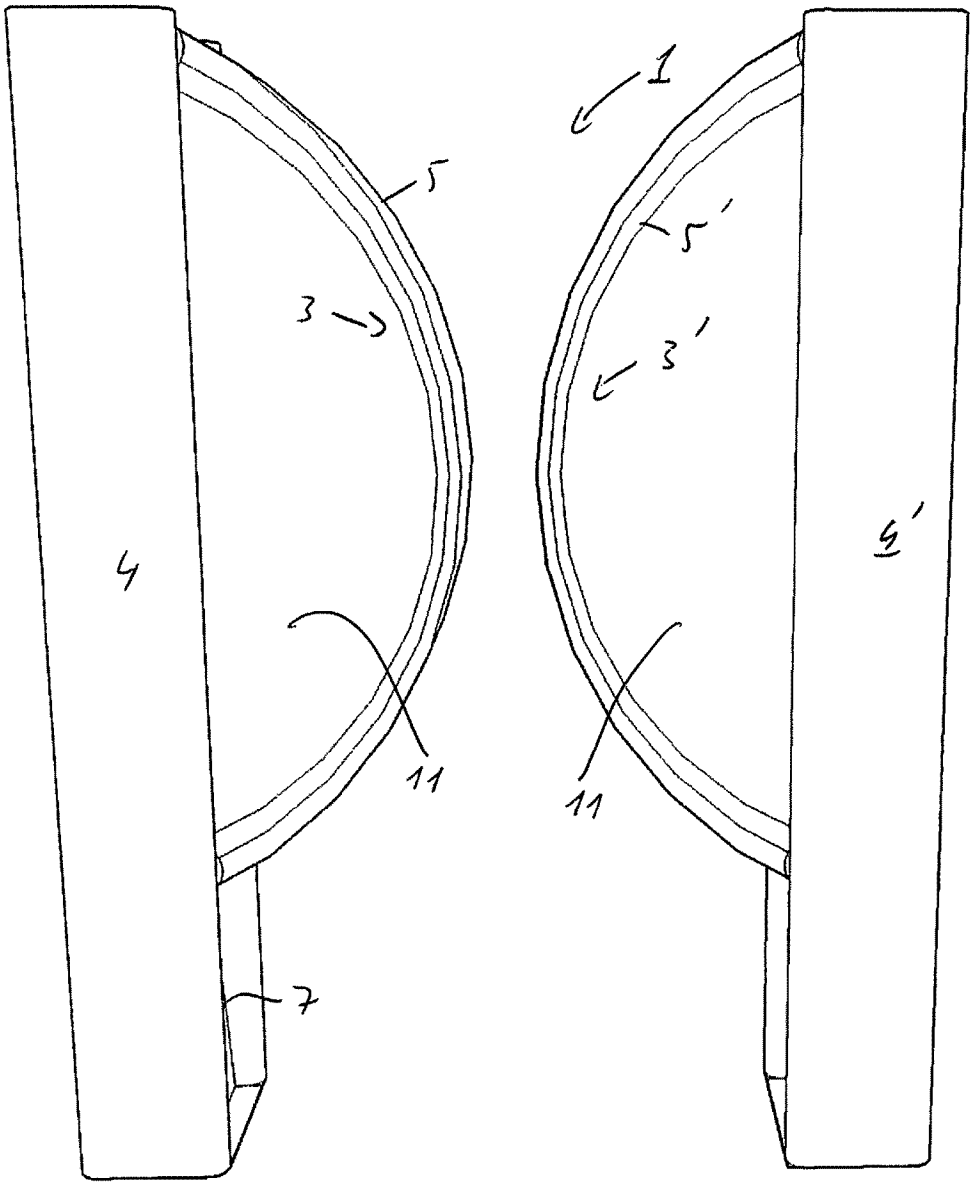
FIG. 6: A schematic view of a further development of the access control device shown in FIG. 2.

According to a further development of the invention and with reference to FIG. 6, the blocking bodies 3 can be connected to a film 11 connected to the carrier 4, which is tensioned in the second position, wherein the film 11 can be illuminated.

Figure 7:
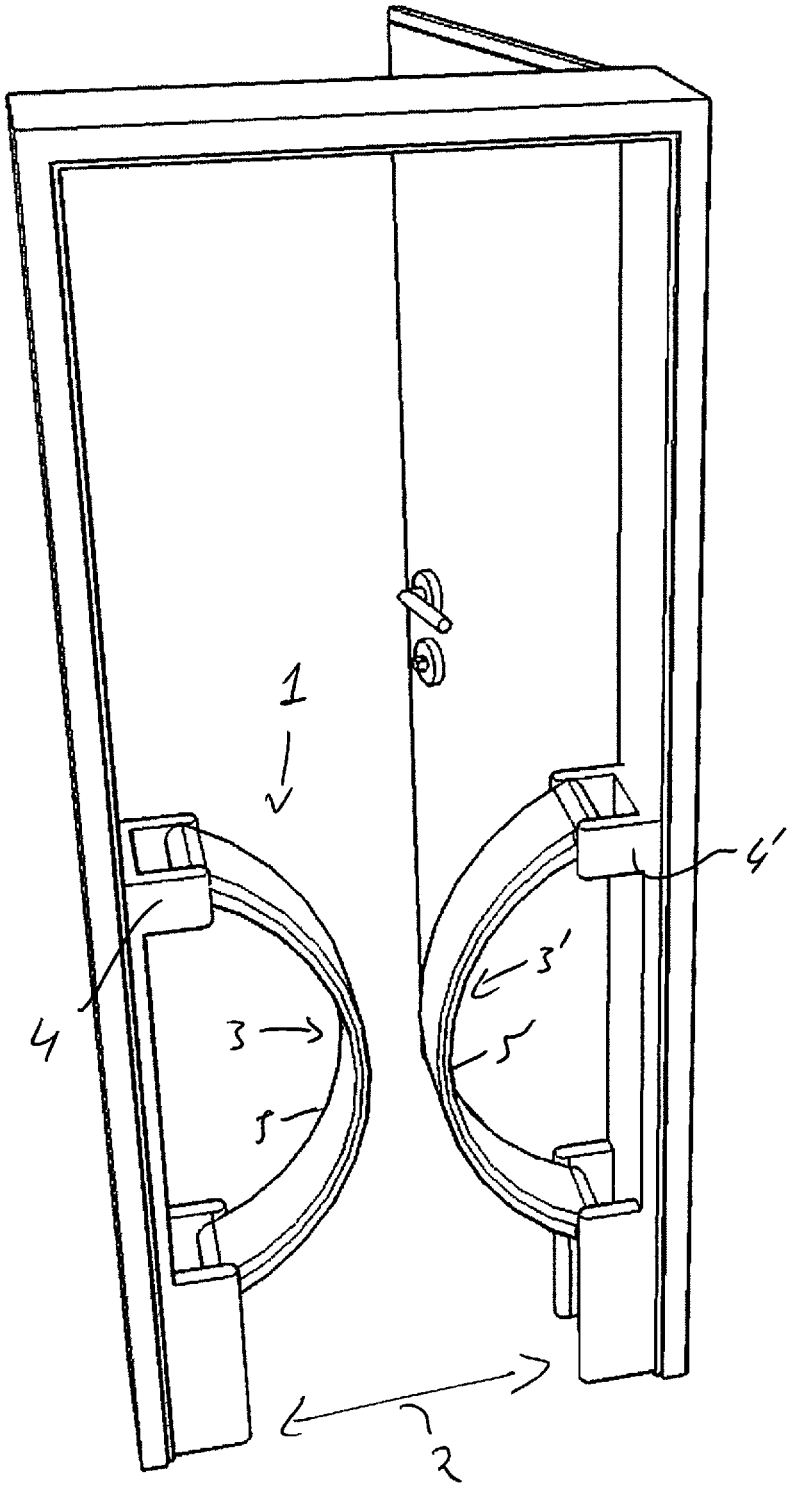
FIG. 7: An example of the use of an access control device to illustrate the compact structure of the access control device.

The access control device according to the invention is constructed very compact through the underlying principle of using a mechanically reversibly deformable element, which, for example, allows the use of the access control device in a door, as illustrated by FIG. 7.

An access control device according to the invention has at least one reading device connected to the controller for access authorizations stored on data carriers. The reading device is preferably designed for the non-contact reading of access authorizations via a standard for wireless communication, for example, via Bluetooth Low Energy (BLE) or RFID. In the case of a valid access authorization, in this case, the at least one blocking body is transferred from the second position to the first position.

The compact construction also advantageously allows the use of the access control device according to the invention for the implementation of a barrier-free access with valid access authorization. In this case, the at least one blocking body is transferred from the first position to the second position when there is an invalid or no access authorization.

According to further embodiments of the invention, a plurality of blocking bodies can be arranged one above the other on a carrier in order to block the passage at respectively different heights.

An access control device according to the invention has the advantage in that it can be modular in design to meet different requirements. For example, the blocking bodies can be exchanged to achieve a form of the blocking body required for the respective application in the second position or a required torsional rigidity.

The invention claimed is:

1. An access control device (1) for a person or a vehicle for blocking or opening a passage (2) of the access control device (1), wherein the access control device (1) comprises at least one blocking body (3, 3'), and each at least one blocking body (3, 3') is arranged on a carrier (4, 4'), each at least one blocking body (3, 3') has a mechanically reversibly deformable element (5, 5') which, in a first position, is substantially planar and opens the passage (2) to permit passage therethrough and, in a second position, assumes a curved shape such that the at least one blocking body (3, 3') at least sufficiently blocks the passage so as to prevent the person or vehicle passing therethrough, at least one end of each mechanically reversibly deformable element (5, 5') is connected or operatively connected to an actuator (7) which is connected to the respective carrier (4, 4') and controllable by a controller, and, by the control of the respective actuator (7), the mechanically reversibly deformable element (5, 5') is transferred from the first position to the second position and vice versa, and one of:

a distance between the ends of each respective at least one blocking body (3, 3') is reduced so as to transfer the mechanically reversibly deformable element (5, 5') from the first position to the second position, or when the ends of the at least one respective blocking body (3, 3') have a constant distance, a length of the blocking body (3, 3') is increased; and the respective actuator (7) is one of a hydraulically, a pneumatically, an electrically or an electromagnetically axially displaceable component along a direction parallel to a longitudinal axis of the mechanically reversibly deformable element (5, 5') in the first position.

2. The access control device (1) according to claim 1, wherein the mechanically reversibly deformable element (5, 5') is designed as a single or a multilayer leaf spring, as a round spring or as an element consisting of a plurality of individual links of the same or different lengths designed and connected, in a hinged manner, to one another, elastically or non-elastically, when the mechanically reversibly deformable element (5, 5') is designed as one of a single or multilayer leaf spring, and a surface normal of the element designed as a leaf spring extends, in the first position, parallel to a plane extending perpendicular to a passage plane and to a passage direction.

3. The access control device (1) according to claim 1, wherein the at least one blocking body (3, 3') comprises two blocking bodies (3, 3'), and the respective carriers (4, 4') are arranged on opposite sides of the passage (2) and are mirror-symmetrical with respect to a central longitudinal axis of the passage (2).

4. The access control device (1) according to claim 1, wherein one end of the respective mechanically reversibly deformable element (5, 5') is respectively connected to an actuator (7) or by a hinge (8) to the carrier (4, 4'), the other end is connected, in a hinged manner, to one end of a non-elastic element (10), the other end of which is connected to an actuator, wherein the length of the respective blocking body corresponds to a length of the respective mechanically reversibly deformable element plus a length of the non-elastic element.

5. The access control device (1) according to claim 1, wherein the mechanically reversibly deformable element (5, 5') is made of rubber, metal, fiberglass reinforced plastic or laminated plastic and has a torsional rigidity by which a bending of the element, by human force, is impossible.

6. The access control device (1) according to claim 2, wherein the surface normal of the respective element (5, 5'), designed as a leaf spring, runs parallel or perpendicular to a passage plane in the first position.

7. The access control device (1) according to claim 2, wherein the side of the mechanically reversibly deformable element (5, 5'), designed as the leaf spring facing the carrier (4, 4'), is convex with respect to the carrier in the first position.

8. The access control device (1) according to claim 1, wherein lighting means are integrated into the respective mechanically reversibly deformable element (5, 5').

9. The access control device (1) according to claim 1, wherein, in the second position, the mechanically reversibly deformable element (5, 5') assumes one of a circular arc or elliptical arc shape.

10. The access control device (1) according to claim 1, wherein, in the first position, a longitudinal axis of the mechanically reversibly deformable element (5, 5') extends perpendicular or parallel to a passage plane.

11. An access control device (1) for a person or a vehicle for blocking or opening a passage (2) of the access control device (1), wherein the access control device (1) comprises at least one blocking body (3, 3'), and each at least one blocking body (3, 3') is arranged on a carrier (4, 4'), each at least one blocking body (3, 3') has a mechanically reversibly deformable element (5, 5') which, in a first position, is substantially planar and opens the passage (2) to permit passage therethrough and, in a second position, assumes a curved shape such that the at least one blocking body (3, 3') at least sufficiently blocks the passage so as to prevent the person or vehicle passing therethrough, at least one end of each mechanically reversibly deformable element (5, 5') is connected or operatively connected to an actuator (7) which is connected to the respective carrier (4, 4') and controllable by a controller, and, by the control of the respective actuator (7), the mechanically reversibly deformable element (5, 5') is transferred from the first position to the second position and vice versa, and one of:

a distance between the ends of each respective at least one blocking body (3, 3') is reduced so as to transfer the mechanically reversibly deformable element (5, 5') from the first position to the second position, or when the ends of the at least one respective blocking body (3, 3') have a constant distance, a length of the blocking body (3, 3') is increased;

one of:

each end of the respective mechanically reversibly deformable element (5, 5') are each connected to the respective actuator (7), or one end of the respective mechanically reversibly deformable element (5, 5') is connected to an actuator (7), the other end is connected by a hinge (8) to the carrier (4, 4'), and a length of each at least one blocking body (3, 3') corresponds to length of the respective mechanically reversibly deformable element (5, 5') between the two actuators or between the actuator and the hinge (8); and the respective actuator (7) is one of a hydraulically, a pneumatically, an electrically or an electromagnetically axially displaceable component along a direction parallel to a longitudinal axis of the mechanically reversibly deformable element (5, 5') in the first position.

12. An access control device (1) for a person or a vehicle for blocking or opening a passage (2) of the access control device (1), wherein the access control device (1) comprises at least one blocking body (3, 3'), and each at least one blocking body (3, 3') is arranged on a carrier (4, 4'), each at least one blocking body (3, 3') has a mechanically reversibly deformable element (5, 5') which, in a first position, is substantially planar and opens the passage (2) to permit passage therethrough and, in a second position, assumes a curved shape such that the at least one blocking body (3, 3') at least sufficiently blocks the passage so as to prevent the person or vehicle passing therethrough, at least one end of each mechanically reversibly deformable element (5, 5') is connected or operatively connected to an actuator (7) which is connected to the respective carrier (4, 4') and controllable by a controller, and, by the control of the respective actuator (7), the mechanically reversibly deformable element (5, 5') is transferred from the first position to the second position and vice versa, and one of:

a distance between the ends of each respective at least one blocking body (3, 3') is reduced so as to transfer the mechanically reversibly deformable element (5, 5') from the first position to the second position, or when the ends of the at least one respective blocking body (3, 3') have a constant distance, a length of the blocking body (3, 3') is increased;

wherein one end of the respective mechanically reversibly deformable element (5, 5') is respectively connected to an actuator (7) or by a hinge (8) to the carrier (4, 4'), the other end is connected, in a hinged manner, to one end of a non-elastic element (10), the other end of which is connected to an actuator, wherein the length of the respective blocking body corresponds to a length of the respective mechanically reversibly deformable element plus a length of the non-elastic element; and the respective actuator (7) connected to the non-elastic element (10) is a hydraulically, pneumatically, electrically or electromagnetically axially displaced component along a direction parallel to a longitudinal axis of the respective leaf spring element (5, 5') in the first position.

* * * * *